US008873117B2

(12) United States Patent
Arikawa et al.

(10) Patent No.: US 8,873,117 B2
(45) Date of Patent: Oct. 28, 2014

(54) SHEET TRANSPORT DEVICE AND IMAGE FORMING APPARATUS

(71) Applicant: Fuji Xerox Co., Ltd., Tokyo (JP)

(72) Inventors: Kiichirou Arikawa, Kanagawa (JP); Hiroko Furukata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/686,522

(22) Filed: Nov. 27, 2012

(65) Prior Publication Data

US 2013/0301089 A1 Nov. 14, 2013

(30) Foreign Application Priority Data

May 11, 2012 (JP) ..... 2012-109564

(51) Int. Cl.

| | |
|---|---|
| ***H04N 1/04*** | (2006.01) |
| ***G06K 15/00*** | (2006.01) |
| ***G06F 3/12*** | (2006.01) |
| ***H04N 1/387*** | (2006.01) |
| ***B41J 11/00*** | (2006.01) |
| ***B41J 13/00*** | (2006.01) |
| ***B65H 5/22*** | (2006.01) |
| ***B65H 5/00*** | (2006.01) |
| ***G03G 15/20*** | (2006.01) |
| ***B65H 5/06*** | (2006.01) |

(52) U.S. Cl.

CPC ..... *B65H 5/062* (2013.01)

USPC ..... 358/498; 358/1.12; 358/450; 358/1.13; 400/611; 400/578; 271/3.14; 271/10.11; 399/67

(58) Field of Classification Search

USPC ..... 358/498; 400/611, 578; 271/3.14, 271/10.11; 399/67; 347/16; 241/236

See application file for complete search history.

(56) References Cited

U.S. PATENT DOCUMENTS

| | | | | |
|---|---|---|---|---|
| 7,357,584 | B2 * | 4/2008 | Suzuki et al. | 400/578 |
| 2005/0133648 | A1 * | 6/2005 | Horiuchi | 241/236 |
| 2005/0230900 | A1 * | 10/2005 | Yamada et al. | 271/10.11 |
| 2011/0091261 | A1 * | 4/2011 | Honma et al. | 400/611 |
| 2012/0127229 | A1 * | 5/2012 | Fukasawa et al. | 347/16 |
| 2012/0236060 | A1 * | 9/2012 | Saito et al. | 347/16 |
| 2013/0175754 | A1 * | 7/2013 | Honma et al. | 271/3.14 |
| 2013/0302054 | A1 * | 11/2013 | Uehara et al. | 399/67 |

FOREIGN PATENT DOCUMENTS

JP 2007-119110 A 5/2007

* cited by examiner

*Primary Examiner* — Charlotte M Baker
*Assistant Examiner* — Rury Grisham
(74) *Attorney, Agent, or Firm* — Sughrue Mion, PLLC

(57) ABSTRACT

A sheet transport device includes a shaft member that extends in an axial direction orthogonal to a sheet transport direction, and a roller that includes plural components which are assembled together so as to surround the shaft member. The components have a shape such that a joint between the components is formed on an outer peripheral surface of the roller which is formed by assembling the components together. The joint extends from one end to another end of the outer peripheral surface in the axial direction while bending or curving at least at a portion in the middle thereof.

12 Claims, 13 Drawing Sheets

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2012-109564 filed May 11, 2012.

BACKGROUND

1. Technical Field

The present invention relates to a sheet transport device and an image forming apparatus.

2. Summary

According to a first aspect of the invention, there is provided a sheet transport device including a shaft member that extends in an axial direction orthogonal to a sheet transport direction, and a roller that includes plural components which are assembled together so as to surround the shaft member, wherein the components have a shape such that a joint between the components is formed on an outer peripheral surface of the roller which is formed by assembling the components together, the joint extending from one end to another end of the outer peripheral surface in the axial direction while bending or curving at least at a portion in the middle thereof.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the accompanying drawings.

Figure 1:
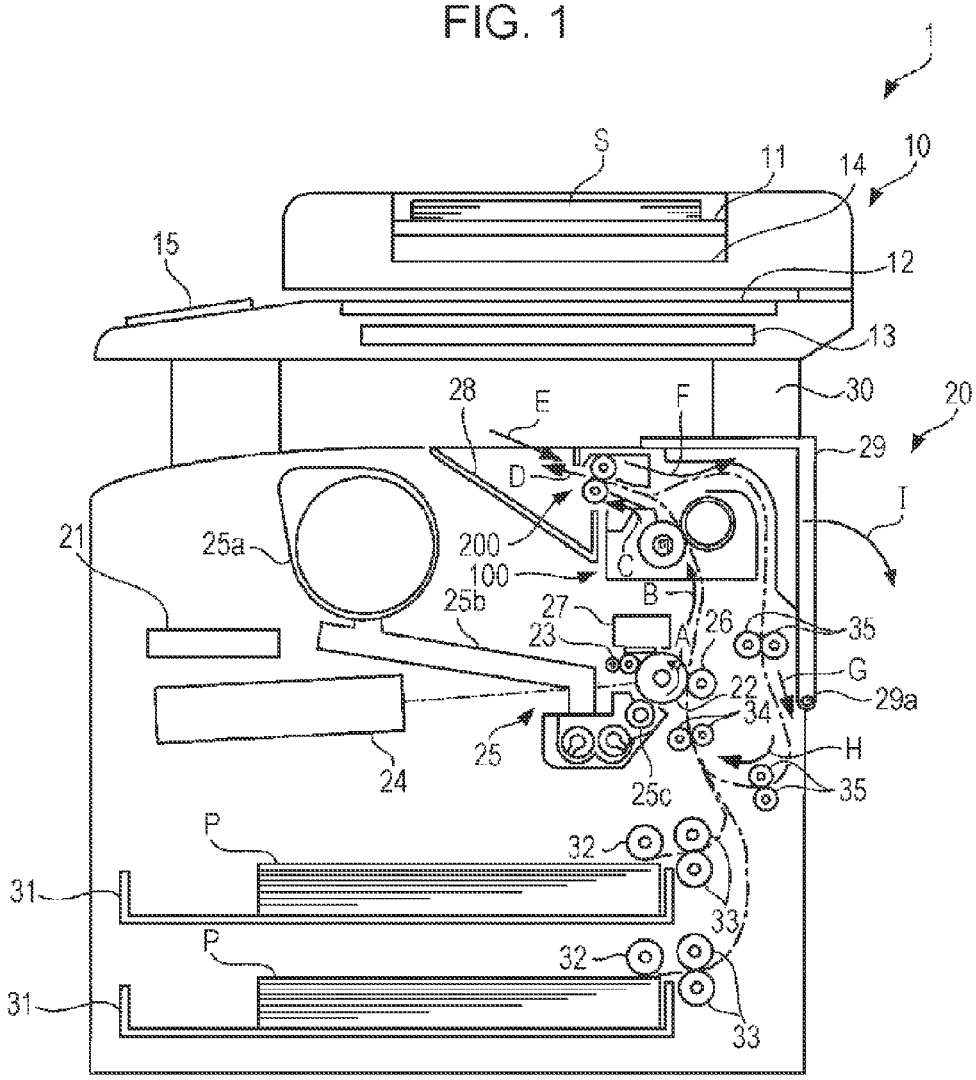
FIG. 1 is a schematic configuration diagram of a copying machine according to an exemplary embodiment of the present invention.

FIG. 1 is a schematic configuration diagram of a copying machine 1 according to an exemplary embodiment of the present invention.

In the copying machine 1 illustrated in FIG. 1, an image forming apparatus according to an exemplary embodiment of the present invention and a sheet transport device according to an exemplary embodiment of the present invention are incorporated.

This copying machine 1 includes a document reading apparatus 10 and an image forming apparatus 20. The document reading apparatus 10 is installed on the image forming apparatus 20. A frame 30 is interposed between the document reading apparatus 10 and the image forming apparatus 20 so as to form a gap therebetween.

The document reading apparatus 10 includes a document sheet tray 11 on which documents S are stacked. The documents S on the document sheet tray 11 are sent one by one so as to be transported through a transport path (not shown) in the document reading apparatus 10. In the course of transportation, a document reading optical system 13 reads text and images recorded on the document S being transported. The document reading optical system 13 is provided below a document reading plate 12 that is made of transparent glass. After the text and images are read, the document S is transported through the transport path so as to be discharged onto a document discharge table 14.

The document reading apparatus 10 includes a hinge that extends in the depth direction of FIG. 1 at the right side of FIG. 1. The document sheet tray 11 and the document discharge table 14 are configured to rotate upward together about the hinge. When the document sheet tray 11 and the document discharge table 14 are rotated upward, the document reading plate 12 appears.

In the document reading apparatus 10, instead of placing documents on the document sheet tray 11, a single document may be placed face down on the document reading plate 12. In this case, the document reading optical system 13 moves from the far side to the near side of FIG. 1 so as to read text and images on the document placed on the document reading plate 12.

Further, the document reading apparatus 10 includes an operation panel 15 at the left side of FIG. 1. The user operates the operation panel 15 so as to input various settings such as the image output form (e.g., double-sided printing and single-sided printing) and the number of copies. A setting signal indicating the settings that are input from the operation panel 15 is output from the document reading apparatus 10 to the image forming apparatus 20.

Also, an image signal is generated on the basis of the read text and images of the document that are read by the document reading optical system 13, and is output from the document reading apparatus 10 to the image forming apparatus 20.

The image forming apparatus 20 forms an image on the basis of the received image signal in the following manner.

The image forming apparatus 20 includes a controller 21 that controls operations of the components of the image forming apparatus 20. The setting signal and the image signal received from the document reading apparatus 10 are input to the controller 21 of the image forming apparatus 20. Then, the image forming apparatus 20 forms an image on the basis of the received setting signal and image signal under the control of the controller 21.

Two sheet trays 31 are accommodated at the bottom of the image forming apparatus 20. Each of the sheet trays 31 stores stacked sheets P. The size of the sheets P may differ between the two sheet trays 31. The sheet trays 31 can be pulled out and pushed in for refilling sheets.

From one of the two sheet trays 31 (e.g., the sheet tray 31 storing the sheets P corresponding to the size of the document or corresponding to the size specified by the setting signal), some of the sheets P are sent by a corresponding one of pickup rollers 32. The sent sheets P are separated one by one by separation rollers 33, and one of the separated sheets P is transported upward such that the leading edge of the sheet P reaches standby rollers 34. The standby rollers 34 serve to send the sheet P such that the timing of the subsequent transport process is adjusted. Thus, the sheet P having reached the standby rollers 34 is further transported by the standby rollers 34 such that the subsequent transport process is adjusted.

The image forming apparatus 20 includes a photoconductor 22 above the standby rollers 34. The photoconductor 22 rotates in the direction of the arrow A. A charging unit 23, an exposure unit 24, a developing unit 25, a transfer unit 26, and a cleaner 27 are provided around the photoconductor 22.

The photoconductor 22 has a cylindrical shape. The photoconductor 22 stores an electric charge when charged, and releases the electrical charge when subjected to exposure. Thus, an electrostatic latent image is formed on the surface of the photoconductor 22.

The charging unit 23 charges the surface of the photoconductor 22 to a specific charge potential.

The exposure unit 24 receives, from the controller 21, the image signal that is obtained by the document reading apparatus 10 as described above. Then, the exposure unit 24 outputs exposure light modulated in accordance with the image signal. The photoconductor 22 is exposed to the exposure light, so that an electrostatic latent image is formed on the surface of the photoconductor 22.

After the electrostatic latent image is formed on the surface of the photoconductor 22 by exposure of the exposure light, the electrostatic latent image is developed by the developing unit 25. The developing unit 25 includes a toner storage 25*a*, a toner supply path 25*b*, and a developing roller 25*c*. In the developing unit 25, the toner stored in the toner storage 25*a* is sent to an area in the vicinity of the developing roller 25*c* through the toner supply path 25*b*. Then, the toner is supplied to the photoconductor 22 by the developing roller 25*c*, so that the electrostatic latent image is developed. Thus, a toner image is formed on the surface of the photoconductor 22.

The standby rollers 34 send the sheet P such that the sheet P reaches a position facing the transfer unit 26 at the timing when the toner image on the photoconductor 22 reaches that position. The toner image of the photoconductor 22 is transferred to the sent sheet P by the transfer unit 26.

The toner remaining on the photoconductor 22 is removed from the photoconductor 22 by the cleaner 27.

The photoconductor 22, the charging unit 23, the exposure unit 24, the developing unit 25, the transfer unit 26, and the cleaner 27 together correspond to an example of an image forming unit according to an exemplary embodiment of the present invention.

The sheet P with the toner image transferred thereto further advances in the direction of the arrow B. The sheet P is heated and pressed by a fixing unit 100, so that an image as a fixed toner image is formed on the sheet P.

The sheet P having passed through the fixing unit 100 advances to a discharge unit 200 in the direction of the arrow C, is further sent by the discharge unit 200 in the direction of the arrow D, and is discharged onto a sheet discharge table 28.

The image forming apparatus 20 is capable of forming images on both sides of the sheet P. In the case of forming images on both sides of the sheet P, after an image is formed on a first side of the sheet P as described above, the sheet P is transported to a reverse position in the direction of the arrows C and D by the discharge unit 200. At the reverse position, the trailing edge of the sheet P is inserted into the discharge unit 200. Subsequently, the discharge unit 200 reverses the sheet transport direction to the direction of the arrow E opposite to the direction of the arrow D, so that the sheet P is drawn in the direction of the arrow E. Then the drawn sheet P advances in the direction of the arrow F, and is further transported by transport rollers 35 in the direction of the arrow G and the arrow H so as to reach the standby rollers 34 again. By the time the sheet P reaches the standby rollers 34, the sheet P has been turned over. Then, the standby rollers 34 send the sheet P such that a second side of the sheet P opposite to the first side on which the image has been formed faces the photoconductor 22. Then, an image is formed on the second side in the same manner as in the case of the first side. After images are formed on both sides of the sheet P in this way, the sheet P is discharged onto the sheet discharge table 28.

The image forming apparatus 20 is configured such that a rear panel 29, which covers the fixing unit 100 and the discharge unit 200, is opened by being rotated in the direction of the arrow I about a support point 29*a*. In the case where the sheet P is jammed between the fixing unit 100 and the discharge unit 200, the user may open the rear panel 29. When the rear panel 29 is opened, an opening appears. Then, the user removes the jammed sheet P by inserting the hand into the opening from the lower side of the document reading apparatus 10.

Figure 2:
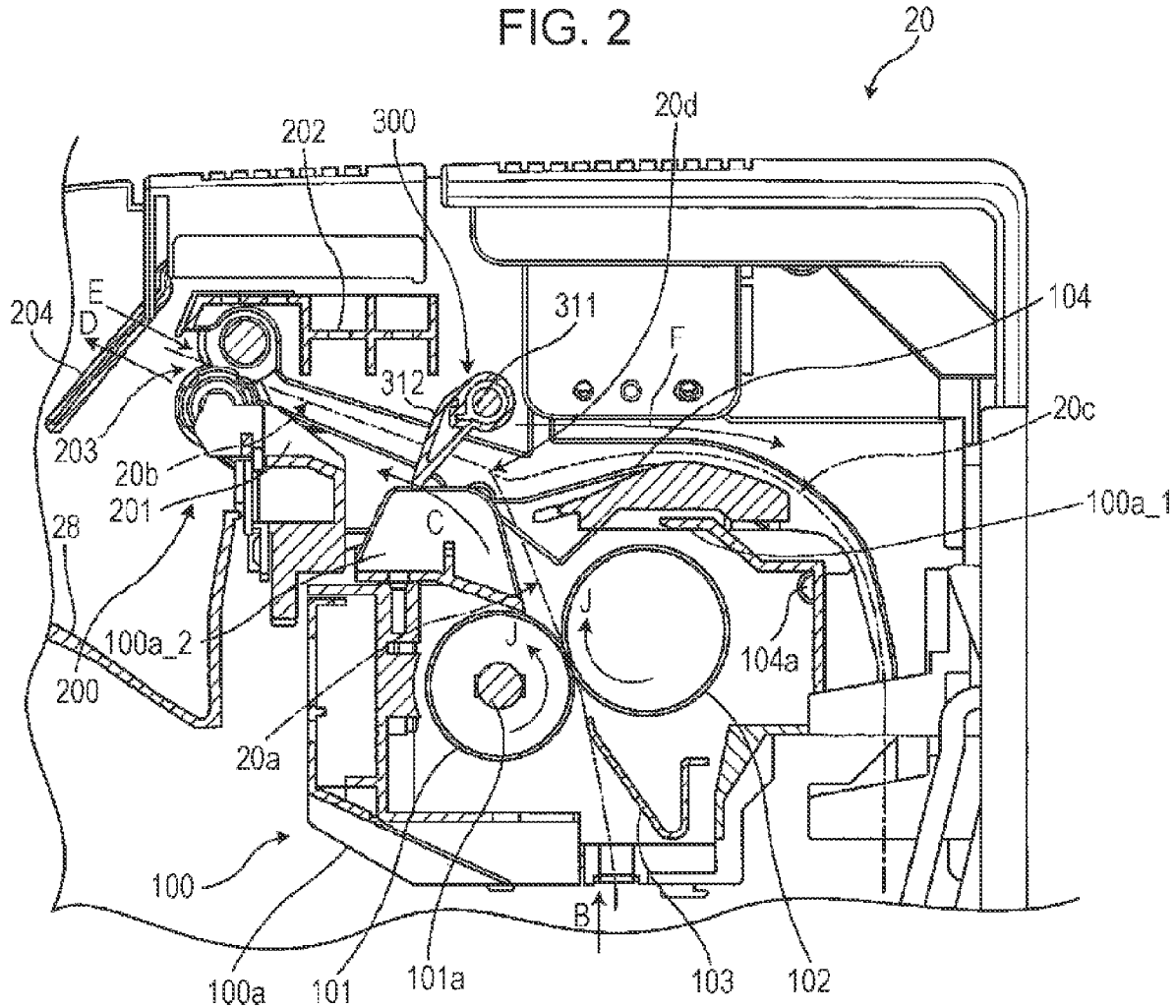
FIG. 2 is a cross-sectional diagram illustrating a fixing unit and a discharge unit of the copying machine of FIG. 1.

FIG. 2 is a cross-sectional diagram illustrating the fixing unit 100 and the discharge unit 200 of the copying machine 1 of FIG. 1. The fixing unit 100 includes a heating roller 101 and a pressure roller 102. The heating roller 101 has a cylindrical shape and has a heat source 101*a* therein. The pressure roller 102 also has a cylindrical shape. The peripheral surface of the pressure roller 102 is pressed against the peripheral surface of the heating roller 101. The sheet having advanced in the direction of the arrow B and reached the fixing unit 100 is guided by a sheet guide 103 to a contact point between the heating roller 101 and the pressing roller 102. The sheet is nipped by the heating roller 101 and the pressure roller 102 at the contact point.

The heating roller 101 and the pressure roller 102 are rotated in the direction of the arrow J while being in contact with each other. Therefore, the sheet having guided to the contact point is nipped by the heating roller 101 and the pressure roller 102 at the contact point, and advances toward the discharge unit 200. At this point, the sheet is heated by the heating roller 101 and is pressed by the pressure roller 102, so that an image as a fixed toner image is formed on the sheet.

The fixing unit 100 further includes a frame 100*a* that rotatably supports the heating roller 101 and the pressure roller 102, and a cover 104 that covers the contact point between the heating roller 101 and the pressure roller 102. The cover 104 is attached to the frame 100*a* so as to be rotatable about a support point 104*a*. The cover 104 is closed so as to be in contact with an extending portion 100*a*_1 of the frame 100*a*, which extends above the pressure roller 102, and to cover the upper side of a first transport path 20*a*. When the sheet passes, an end of the cover 104 is lifted by the sheet. Further, the fixing unit 100 includes fixing-unit-side guide ribs 100*a*_2 that guides the sheet in the first transport path 20*a* to the discharge unit 200. The plural fixing-unit-side guide ribs 100*a*_2 are arranged in a sheet width direction (a direction perpendicular to the paper surface of FIG. 2). When the above-described cover 104 is in the closed position, the end opposite to an end at the support point 104*a* side is disposed between the fixing-unit-side guide ribs 100*a*_2.

The discharge unit 200 includes a lower frame 201 that serves as a lower guide in a second transport path 20*b* in the discharge unit 200, an upper frame 202 that serves as an upper guide, and a discharge member 203 that sends the sheet. The discharge unit 200 further includes a detector 300 that detects the sheet having been transported.

The detector 300 includes a shaft 311 that is rotatable and extends in a direction perpendicular to the paper surface of FIG. 2, and a detection claw 312 fixed to the shaft 311. When the leading edge of the sheet reaches the detector 300, the detection claw 312 is rotated together with the shaft 311 in the upward direction by the leading edge of the sheet, so that the rotation of the shaft 311 is photoelectrically detected. In this way, the detector 300 detects whether the sheet has reached the detector 300.

The detector 300 monitors whether the sheet reaches the detector 300 at the timing when the sheet is supposed to reach the detector 300, thereby serving to check whether this apparatus is operating properly. The sheet detection result obtained by the detector 300 is reported to the controller 21 (see FIG. 1). If the sheet does not reach the detector 300 at the timing when the sheet is supposed to reach the detector 300, an error such as paper jam is determined to have occurred. Then, the controller 21 stops operations of the apparatus and notifies the user of the error.

The image forming apparatus 20 has a single-sided printing mode for forming an image only on one side of the sheet, and a double-sided printing mode for printing images on both sides of the sheet. The single-sided mode or the double-sided mode is selected on the operation panel 15 of FIG. 1, and the selection is reported to the controller 21 (see FIG. 1) in the form of a setting signal. When the double-sided printing mode is selected, the discharge member 203 reverses a rotational direction thereof while transporting the sheet in the direction of the arrow D direction, and thus transports the sheet in the direction of the arrow E. The detector 300 also serves to determine the timing of reversing the rotation. More specifically, the detector 300 counts the time elapsed from the detection of the leading edge of the sheet, and reverses the rotation when the trailing edge of the sheet reaches a branch point 20*d* and thus the above-described cover 104 is closed again.

The discharge unit 200 has a pressing piece 204. The pressing piece 204 presses, from above, the sheet having been discharged onto the sheet discharge table 28 so as to prevent the sheet from being lifted and interfering with the discharge of the following sheet.

The pressing piece 204 is rotatable about an upper end thereof. When the sheet being discharged by the discharge member 203 pushes the pressing piece 204, the pressing piece 204 rotates so as to open the path of the sheet. Then, when the trailing edge of the sheet passes the discharge member 203, the pressing piece 204 is returned to the position shown in FIG. 2 so as to press the trailing edge of the sheet downward. Thus, a discharge path for the following sheet is secured.

The following description is focused on transport of the sheet.

The sheet having passed through the fixing unit 100, in which a toner image is fixed onto the first side of the sheet, passes through the first transport path 20*a* in the direction of the arrow C while pushing up the end of the cover 104, and then passes through the second transport path 20*b* in the direction of the arrow D while pushing up the detection claw 312. When the leading edge of the sheet reaches the discharge member 203, the sheet is further transported in the direction of the arrow D by the discharge member 203. In the case of the single-sided printing mode, the sheet is directly discharged onto the sheet discharge table 28.

In the case of the double-sided printing mode, the sheet with an image formed only on the first side is transported in the direction of the arrow D by the discharge member 203 in the same manner as in the case of the single-sided printing mode. When the trailing edge of the sheet reaches the branch point 20*d*, the rotation of the discharge member 203 is reversed. Then, the sheet advances in the direction of the arrow E. The cover 104 prevents the sheet from entering the first transport path 20*a* which the sheet has just passed through, so that the sheet is guided by the upper surface of the cover 104 so as to be transported through a third transport path 20*c* in the direction of the arrow F. The third transport path 20*c* extends to the standby rollers 34 (see FIG. 1) so as to meet the first transport path 20*a*. The sheet is turned over by passing through the third transport path 20*c* such that the second surface on which an image is to be formed faces the photoconductor 22 (see FIG. 1). The sheet is sent by the standby rollers 34 in the same manner as in the case of the formation of an image on the first side. After that, an image is formed on the second side in the same manner as in the case of the formation of an image on the first side. When images are formed on both sides of the sheet in this way, the sheet is discharged onto the sheet discharge table 28.

Figure 3:
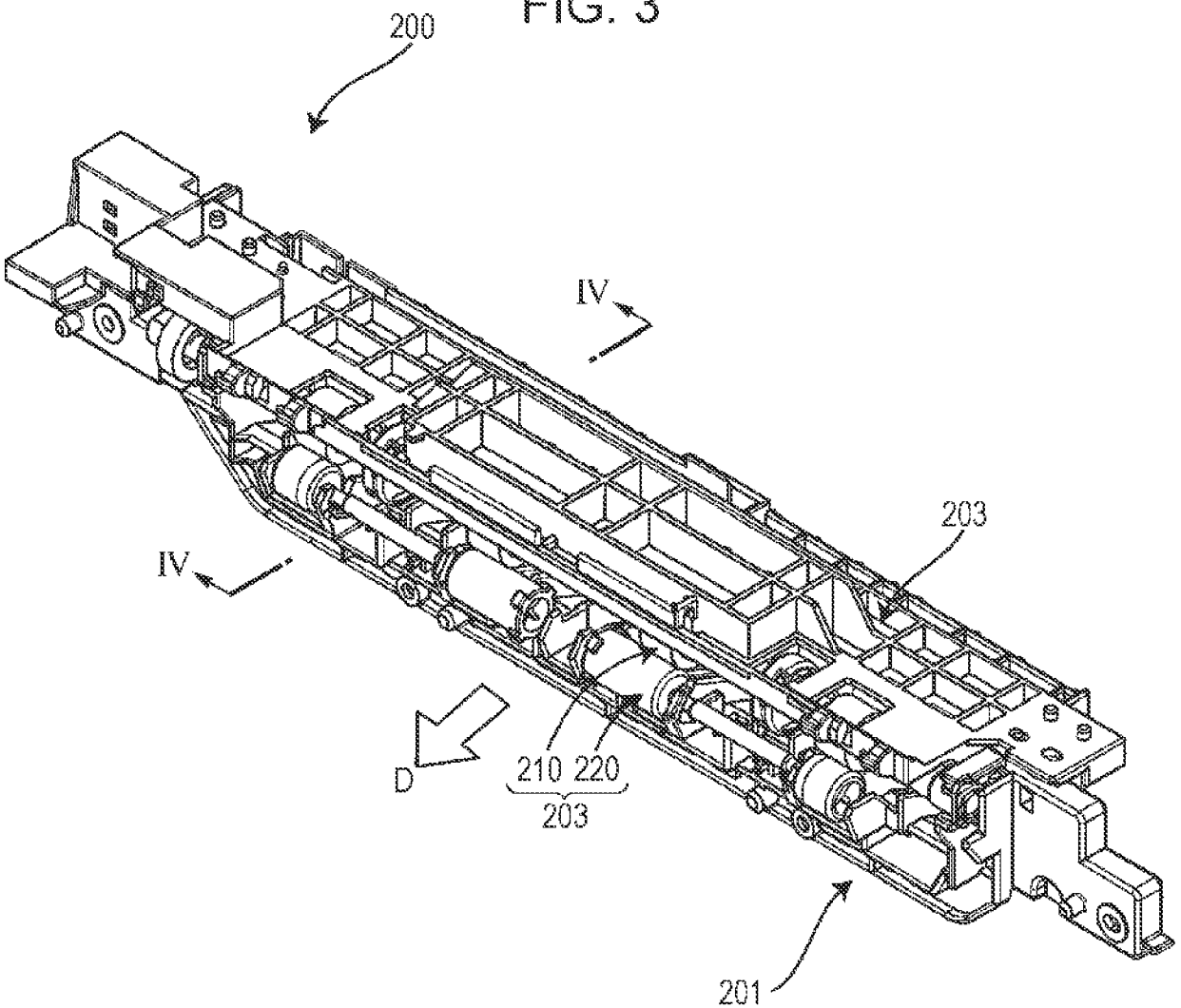
FIG. 3 is a perspective view of the discharge unit as viewed from a discharge member side.
Figure 4:
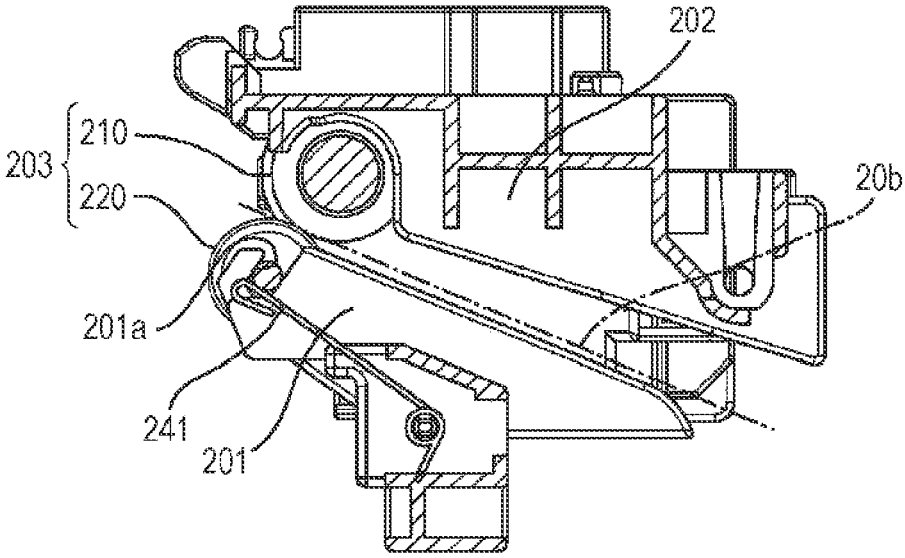
FIG. 4 is a cross-sectional view of the discharge unit taken along the line IV-IV in FIG. 3.
Figure 5:
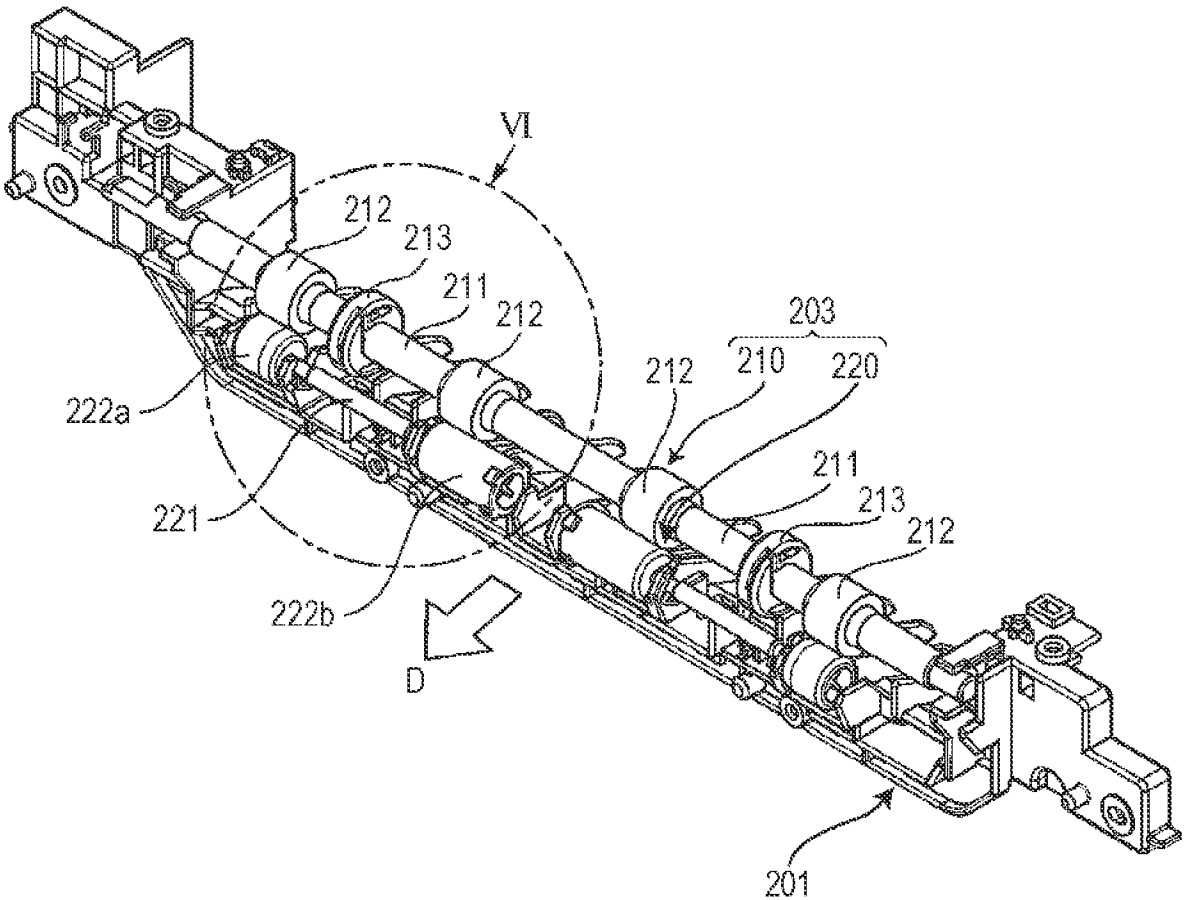
FIG. 5 is a perspective view of a lower frame and a discharge member of the discharge unit with an upper frame removed.
Figure 6:
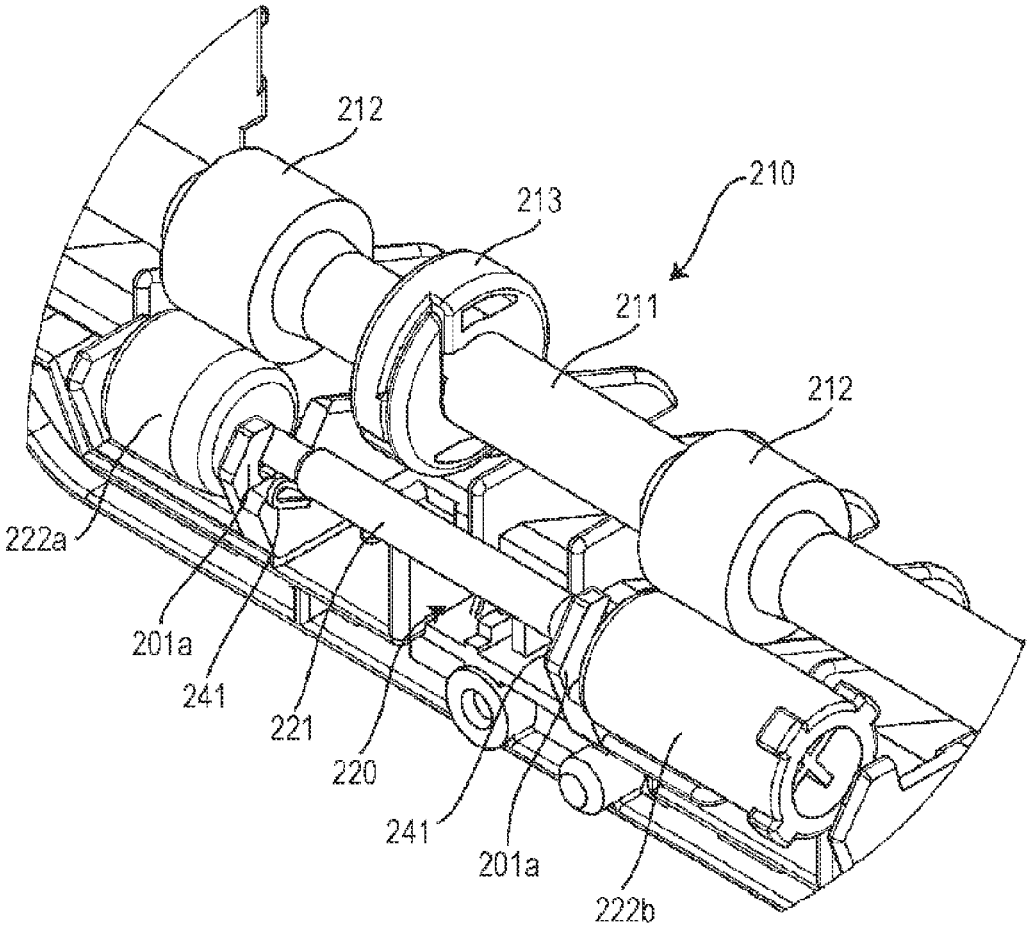
FIG. 6 is an enlarged view of the portion indicated by the circle VI in FIG. 5.

FIG. 3 is a perspective view of the discharge unit 200 as viewed from a discharge member side. FIG. 4 is a cross-sectional view of the discharge unit 200 taken along the line IV-IV in FIG. 3. FIG. 5 is a perspective view of the lower frame 201 and the discharge member 203 of the discharge unit 200 with the upper frame 202 removed. FIG. 6 is an enlarged view of the portion indicated by the circle VI in FIG. 5.

The discharge member 203 includes a driving member 210 and driven members 220. A sheet (not shown) having passed through the second transport path 20*b* of FIG. 4 (see also FIG. 2) is held between the driving member 210 and the driven members 220. Thus, the sheet is transported in the direction of the arrow D of FIG. 3 (see also FIG. 2), and is discharged onto the sheet discharge table 28 shown in FIGS. 1 and 2.

The driving member 210 includes a shaft member 211, driving rollers 212, and curve imparting rollers 213. The shaft member 211 is a rod-shaped member that is rotated by a driving force from a motor (not shown). The driving rollers 212 are made of rubber, and are press-fitted onto the shaft member 211 from the axial direction. The driving rollers 212 transport the sheet by holding the sheet with driven rollers 222*a* and 222*b*. The curve imparting rollers 213 have a greater diameter than the driving rollers 212, and are made of a material having a low coefficient of friction with respect to the sheet. The curve imparting rollers 213 serve to corrugate the sheet being transported by the driving rollers 212, in the width direction of the sheet.

In the case where the sheet comes out flat without being corrugated in the width direction, the leading edge of the sheet being discharged drops onto the sheet discharge table 28 (see FIGS. 1 and 2) so as to come into contact with a sheet that has already been discharged onto the sheet discharge table 28 and thus to push the already discharged sheet in the direction out of the sheet discharge table 28. This might result in disordering the sheets stacked on the sheet discharge table 28. On the other hand, in the case where the sheet comes out to the sheet discharge table 28 with a widthwise corrugated shape, the sheet is substantially linearly discharged in the discharge direction, so that the leading edge of the sheet is less likely to drop onto the sheet discharge table 28. Thus, the sheet is placed onto the sheet discharge table 28 without disordering the sheets on the sheet discharge table 28.

Each of the curve imparting rollers 213 of this exemplary embodiment includes plural (two in this exemplary embodiment) components made of resin. The curve imparting rollers 213 are attached, after the driving rollers 212 are press-fitted onto the shaft member 211, to the shaft member 211 from a lateral direction orthogonal to the axial direction, instead of being attached to the shaft member 211 from the axial direction.

The driving member 210 of this exemplary embodiment includes two curve imparting rollers 213. In this exemplary embodiment, two of the driving rollers 212 are disposed at the center between the two curve imparting rollers 213. Supposing that the curve imparting rollers 213 are designed to be attached to the shaft member 211 from the axial direction, the driving rollers 212 and the curve imparting rollers 213 that are made of different materials need to be alternately attached to the shaft member 211. This makes it difficult to assemble the driving member 210. On the other hand, each of the curve imparting rollers 213 of this exemplary embodiment includes two components, and may be attached, after the driving rollers 212 are press-fitted onto the shaft member 211, to the shaft member 211 from the lateral direction in a manner such that the two components clamp the shaft member 211 therebetween. Thus, the driving member 210 is easily assembled.

Each of the driven members 220 includes a shaft 221 of the driven member 220, and two driven rollers 222*a* and 222*b* disposed on the opposite ends of the shaft 221. The shaft 221 and the two driven rollers 222*a* and 222*b* are molded integrally from resin. As illustrated in FIG. 5, the two driven members 220 are arranged in the axial direction (the sheet width direction), and a total of four driven rollers 222*a* and 222*b* are disposed so as to face the respective four driving rollers 212 of the driving member 210.

The shaft 221 of each driven member 220 is rotatably supported by bearings 201*a* (see FIG. 6) formed in the lower frame 201. The bearings 201*a* have a fork shape.

Further, spring members 241 that press the shaft 221 of the driven member 220 toward the driving member 210 are provided in the vicinity of the respective bearings 201*a*. The driven rollers 222*a* and 222*b* are pressed against the driving rollers 212 with the biasing force of the spring members 241.

In the case where the curve imparting rollers 213 are provided on the driven members 220, if a sheet that does not easily bend, such as a thick sheet, is used, the driven members 220 are pushed by the sheet so as to be moved away from the driving member 210 against the biasing force of the spring members 241. That is, the driven rollers 222*a* and 222*b* are moved away from the driving rollers 212, which might result in an insufficient driving force. In this exemplary embodiment, since the curve imparting rollers 213 are included in the driving member 210, even if a sheet that does not easily bend is used, a sufficient driving force is constantly obtained.

In the following, the curve imparting rollers 213 will be described in greater detail.

Figure 7:
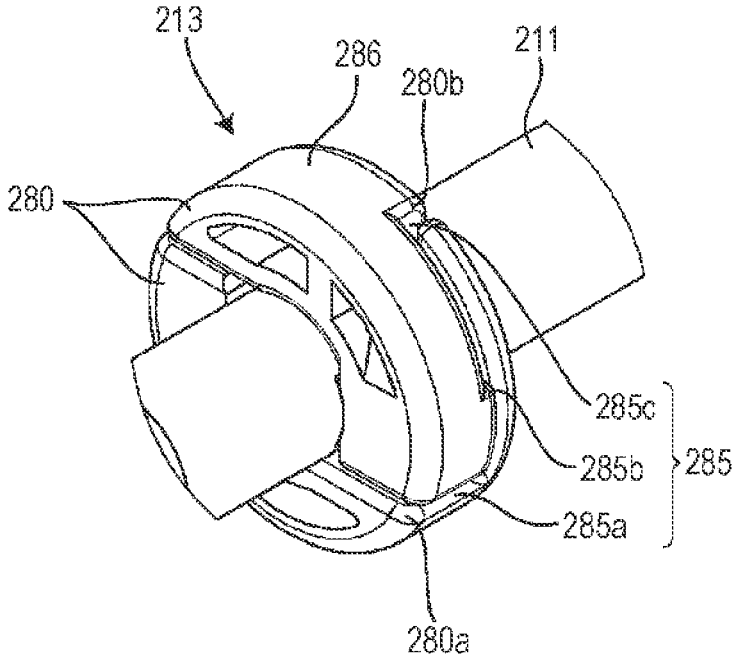
FIG. 7 is a perspective view of a curve imparting roller attached to a shaft member of a driving member.
Figure 8:
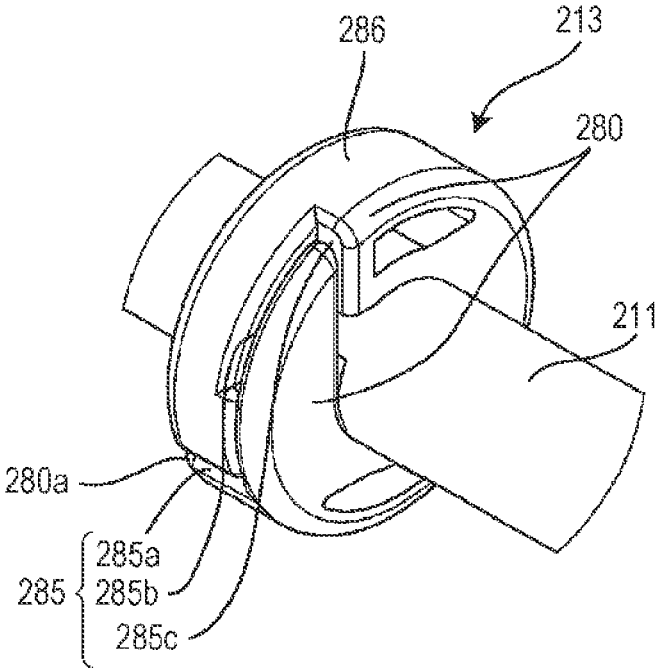
FIG. 8 is a perspective view of the curve imparting roller attached to the shaft member of the driving member as viewed from an angle different from that in FIG. 7.

FIGS. 7 and 8 are perspective views of one of the curve imparting rollers 213 attached to the shaft member 211 of the driving member 210 as viewed from different angles.

The curve imparting roller 213 includes two components 280 made of resin. In this exemplary embodiment, these two components 280 have the same shape. The two components 280 of the same shape are oriented in the same direction with respect to the axial direction of the shaft member 211, and are displaced from each other by 180 degrees in the rotational direction of the shaft member 211, and are coupled together so as to clamp the shaft member 211 therebetween. Thus, the two components 280 form the curve imparting roller 213.

A joint 285 between the two components 280 is formed in an outer peripheral surface 286 of the curve imparting roller 213. This joint 285 has a so-called stepped shape, including a first portion 285*a* extending in an axial direction (i.e., a direction in which the shaft member 211 extends) from an axial end 280*a* of the outer peripheral surface 286 of the curve imparting roller 213, a second portion 285*b* continuous with the first portion 285*a* and extending in a circumferential direction of the outer peripheral surface 286, and a third portion 285*c* continuous with the second portion 285*b* and extending to another axial end 280*b*. The second portion 285*b* of the joint 285 extending in the circumferential direction is formed at an inner side in a width direction of the sheet being transported.

Since the joint 285 is formed into a stepped shape as described above, and since the second portion 285*b* is formed at an inner side in a width direction of the sheet being transported, a transport error due to the leading edge of the transported sheet entering the joint 285 may be prevented.

Figure 9:
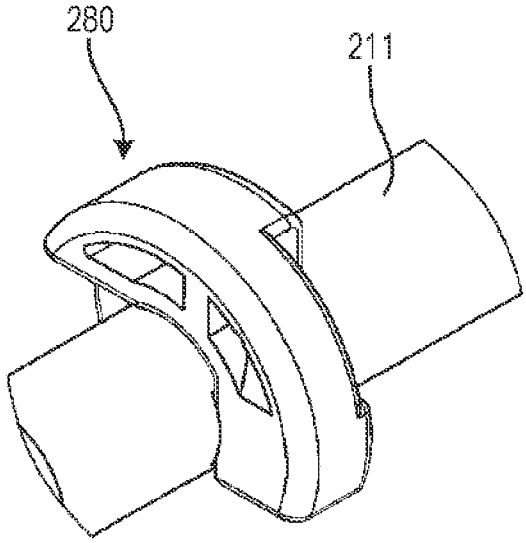
FIG. 9 is a perspective view of one of two components of the curve imparting roller attached to the shaft member.
Figure 10:
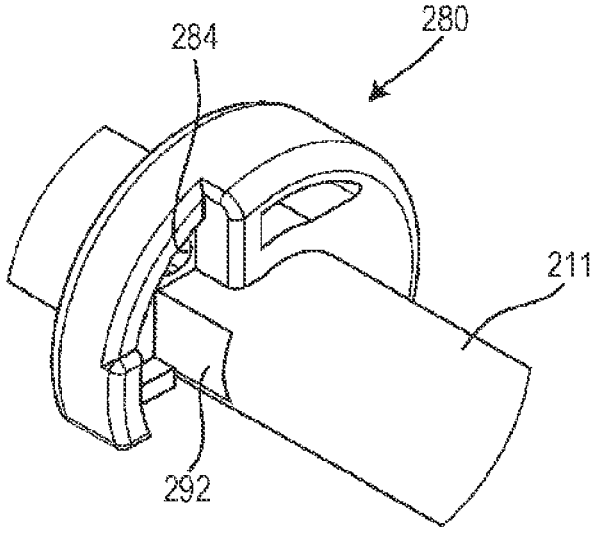
FIG. 10 is a perspective view of the component of FIG. 9 attached to the shaft member as viewed from an angle different from that in FIG. 9.
Figure 11:
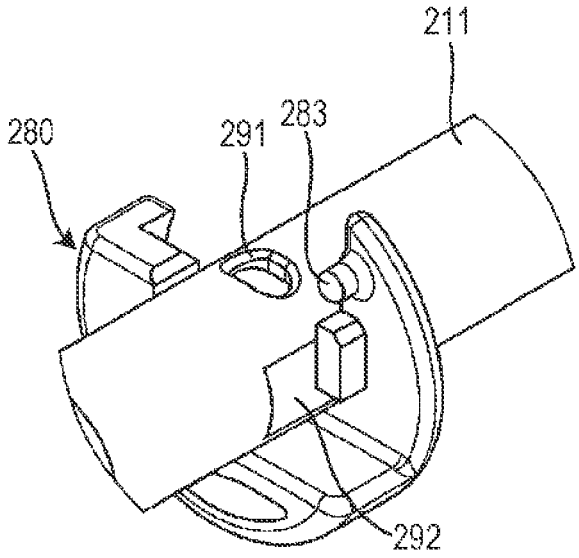
FIG. 11 is a perspective view of the other component attached to the shaft member.
Figure 12:
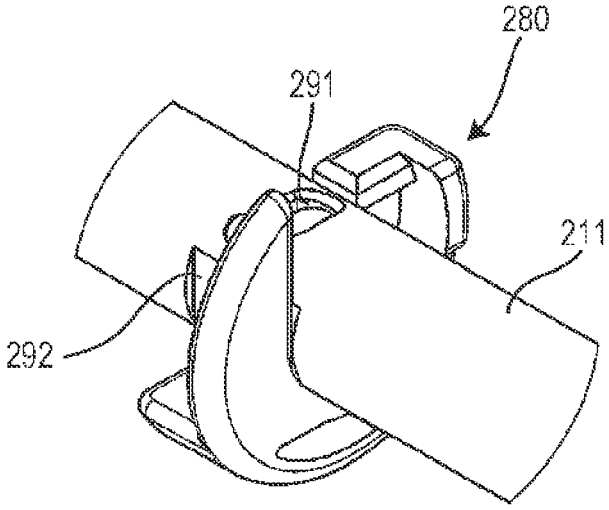
FIG. 12 is a perspective view of the other component of FIG. 11 attached to the shaft member as viewed from an angle different from that in FIG. 11.
Figure 13:
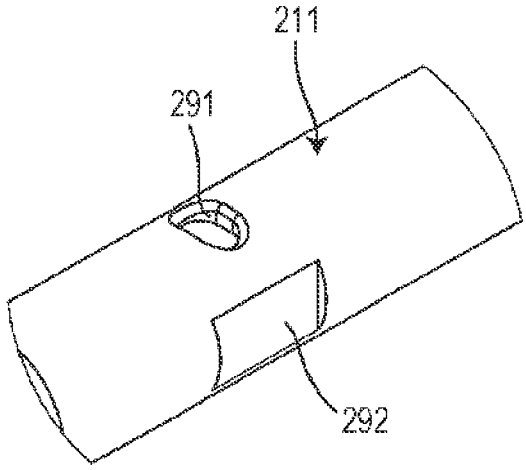
FIG. 13 is a perspective view of a curve imparting roller attachment portion of the shaft member.
Figure 14:
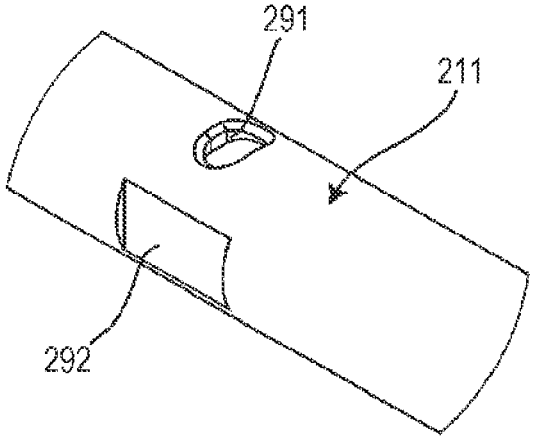
FIG. 14 is a perspective view of the curve imparting roller attachment portion of the shaft member as viewed from an angle different from that in FIG. 13.
Figure 15:
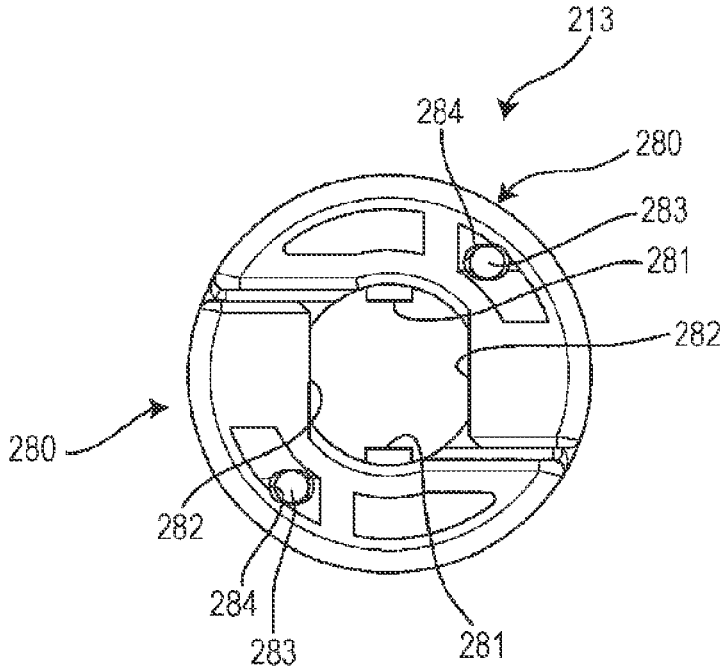
FIG. 15 is a front view of the curve imparting roller as viewed from one side in the axial direction, wherein the two components are coupled together.
Figure 16:
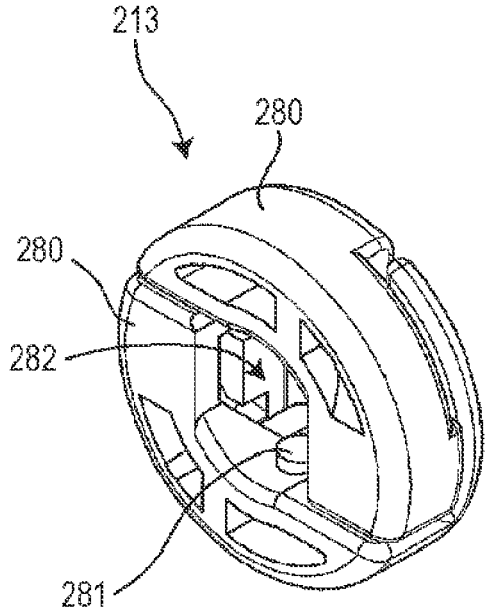
FIG. 16 is a perspective view of the curve imparting roller as viewed from one side in the axial direction, wherein the two components are coupled together.
Figure 17:
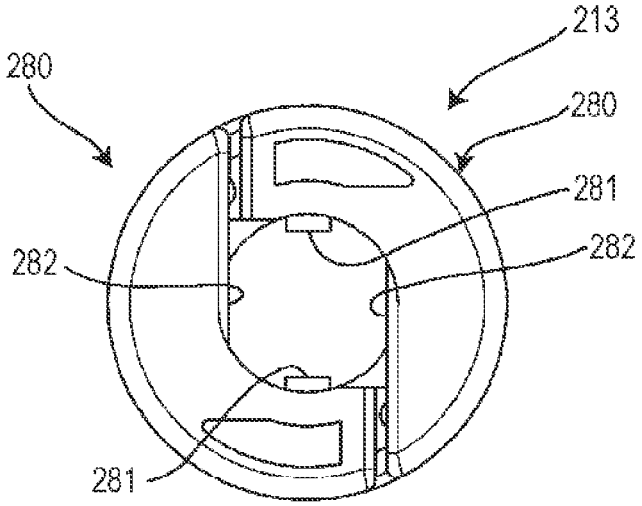
FIG. 17 is a plan view of the curve imparting roller as viewed from the other side in the axial direction, wherein the two components are coupled together.
Figure 18:
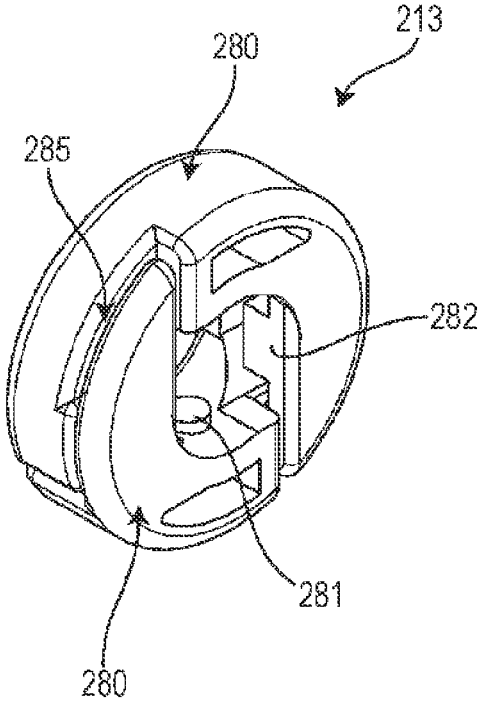
FIG. 18 is a perspective view of the curve imparting roller as viewed from the other side in the axial direction, wherein the two components are coupled together.

FIGS. 9 and 10 are perspective views of one of the two components 280 of the curve imparting roller 213 attached to the shaft member 211 as viewed from different angles. FIGS. 11 and 12 are perspective views of the other one of the two components 280 attached to the shaft member 211 as viewed from different angles. FIGS. 13 and 14 are perspective views of a curve imparting roller attachment portion of the shaft member 211 as viewed from different angles. FIGS. 15 and 16 are a plan view and a perspective view, respectively, of the curve imparting roller 213 as viewed from one side in the axial direction, wherein the two components 280 are coupled together. FIGS. 17 and 18 are plan view and a perspective view, respectively, of the curve imparting roller 213 as viewed from the other side in the axial direction, wherein the two components 280 are coupled together.

Each component 280 includes a projection 283 that projects axially for engagement with the other component 280 (see FIGS. 11 and 15), and a hole 284 (see FIGS. 10 and 15) to receive the projection 283 of the other component 280.

In the shaft member 211, recesses 291 and partial flat portions 292 are formed as illustrated in FIGS. 13 and 14. The recesses 291 are formed at positions in the shaft member 211 that are displaced from each other by 180 degrees. Similarly, the flat portions 292 are formed at positions that are displaced from each other by 180 degrees. On the other hand, each component 280 of the curve imparting roller 213 includes a protrusion 281 that protrudes toward the shaft member 211 so as to be inserted into the recess 291 of the shaft member 211, and a flat portion 282 that comes into contact with the flat portion 292 of the shaft member 211 so as to be locked against rotation with respect to the shaft member 211.

The two components 280 having the structure described above are coupled together so as to surround the shaft member 211. Thus, the attitude of the curve imparting roller 213 with respect to the shaft member 211 and the position of the curve imparting roller 213 in the axial direction are fixed.

Since the curve imparting roller 213 has the structure described above, the curve imparting roller 213 may be attached to the shaft member 211 after the driving rollers 212 are press-fitted onto the shaft member 211. Thus, the driving member 210 is easily assembled.

A roller material having the same structure as the curve imparting roller described above may be used not only as a curve imparting roller, but also as a transport roller that transports a sheet, such as the standby roller 34 and the transport roller 35 of the image forming apparatus 20 of the copying machine 1 shown in FIGS. 1 and 2.

Figure 19:
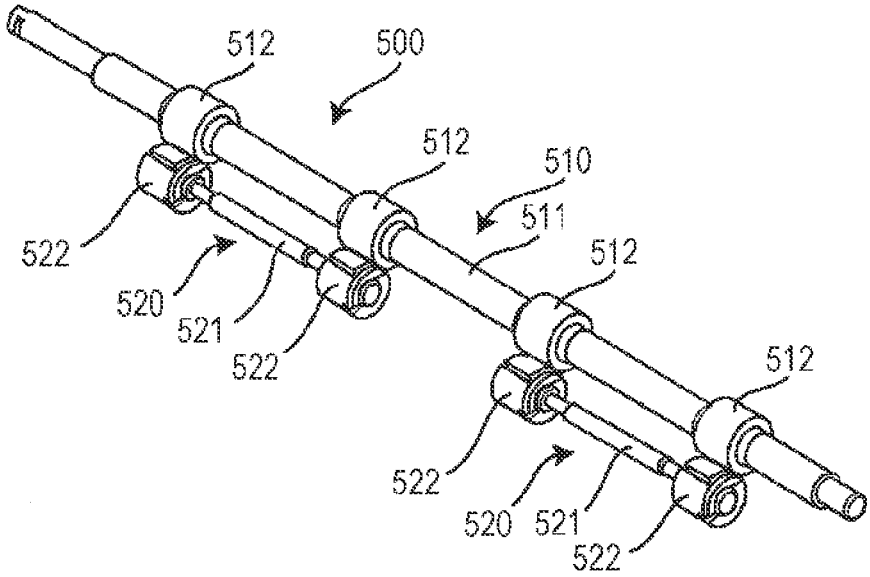
FIG. 19 is a perspective view of an example of a transport member.

FIG. 19 is a perspective view of an example of a transport member 500.

The transport member 500 includes a driving member 510 and two driven members 520.

The driving member 510 includes a shaft member 511 that is rotated by a motor (not shown), and four driving rollers 512 that are made of rubber and are press-fitted onto the shaft member 511 from the axial direction.

Each of the two driven members 520 includes a shaft member 521 of the driven member 520, and two driven rollers 522 attached to the shaft member 521.

A total of four driven rollers 522 oppose the respective four driving rollers 512, and are pressed against the opposing driving rollers 512 by spring members (not shown).

A sheet (not shown) is held between the driving rollers 512 and the driven rollers 522 so as to be transported by rotation of the driving member 510.

Each of the driven rollers 522 of the driven member 520 includes two components having the same basic structure as the two components 280 of the above-described curve imparting roller 213.

In the shaft member 521 of the driven member 520 of FIG. 19, recesses and flat portions are formed that are similar to the recesses 291 and the flat portions 292 shown in FIGS. 13 and 14.

In the case where the shaft member 521 of the driven member 520 of FIG. 19 is supported by bearings similar to the bearings 201*a* of FIGS. 4 and 5, for example, since the shaft member 521 slidably rotates on the bearings, the friction coefficient of the shaft member 521 may be made as small as possible. On the other hand, since the driven rollers 522 transport the sheet by holding the sheet with the driving rollers 512, the driven rollers 522 may have a certain degree of high friction coefficient in order to transport the sheet with a sufficient force, without slipping on the sheet being transported. In the case where these conditions need to be satisfied, it is not possible to integrally mold the shaft member 521 and the driven rollers 522 of the driven member 520 from the same material. Therefore, the shaft member 521 and the driven rollers 522 may be molded separately and assembled together. In order to satisfy these conditions, the above-described roller of the type that is formed by assembling plural components may be used as a roller that transports a sheet by holding the sheet with another roller.

Although FIG. 19 illustrates an example in which the roller of the type that is formed by assembling plural components is used as the driven roller 522, the roller of this type may be used as an roller on the driving member side.

In the above description, as depicted in FIGS. 7 and 8, the components are illustrated that form a joint which includes the first portion 285*a* axially extending from the axial end 280*a* of the outer peripheral surface 286 of the roller 213, the second portion 285*b* extending in the circumferential direction of the outer peripheral surface 286, and the third portion 285*c* axially extending to the other axial end 280*b*. However, a joint to be formed in the exemplary embodiment is not limited to the joint having such a shape. More specifically, the joint is not limited to one that extends linearly from one end to the other end in the axial direction, and may include those having a shape that extends from one end to the other end while bending or curving at least at a portion in the middle thereof. If the joint has such a shape, a transport error due to the leading edge of the transport sheet entering the joint may be prevented. In the case of the joint having such a shape, as in the case described above, at least a part of the bent or curved portion of the joint may be formed at an inner side in a width direction of the sheet being transported.

In the above description, the image forming apparatus that is shown in FIGS. 1 and 2 and that forms a monochrome image is illustrated. However, the image forming apparatus according to the above-described exemplary embodiment may be implemented as an image forming apparatus that forms a color image. Further, the sheet transport device according to the above-described exemplary embodiment may be applied not only to image forming apparatuses, but also to other apparatuses having a mechanism that transports a sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet transport device comprising:

a shaft member extending in an axial direction orthogonal to a sheet transport direction; and a roller comprising a plurality of components which are assembled together to form an assembled roller, the assembled roller provided on the shaft member;

wherein the assembled roller comprises a joint provided between the components and on an outer peripheral surface of the assembled roller, and wherein the joint extending from one end to another end of the outer peripheral surface in the axial direction and comprising a bending portion or a curving portion.

2. The sheet transport device according to claim 1, wherein the joint comprises a first portion extending in the axial direction from the one end of the outer peripheral surface in the axial direction, a second portion extending in a circumferential direction of the outer peripheral surface, and a third portion extending in the axial direction to the another end.

3. The sheet transport device according to claim 1, wherein the roller is configured to rotate in synchronization with respect to the shaft member.

4. The sheet transport device according to claim 3, wherein the shaft member comprises recesses and flat portions corresponding to the components and provided at an attachment position for the roller;

wherein the components comprise protrusions to be inserted into the respective recesses, and flat portions to be brought into contact with the respective partial flat portions; and wherein the protrusions are inserted into the respective recesses and the flat portions are brought into contact with the partial flat portions such that a position of the roller in the axial direction is fixed.

5. The sheet transport device according to claim 1, wherein at least a part of the bending portion or curving portion of the joint is provided at an inner side of the roller in the axial direction.

6. The sheet transport device according to claim 1, wherein the roller is configured to corrugate, in the axial direction, a sheet being transported.

7. The sheet transport device according to claim 1, wherein the roller is one of a pair of rollers configured to transport a sheet by holding the sheet therebetween.

8. An image forming apparatus comprising:

a transport unit that transports a sheet; and an image forming unit that forms an image on the transported sheet;

wherein the transport unit comprises:

a shaft member extending in an axial direction orthogonal to a sheet transport direction; and a roller comprising a plurality of components which are assembled together to form an assembled roller, the assembled roller provided on the shaft member;

wherein the assembled roller comprises a joint provided between the components and on an outer peripheral surface of the assembled roller, and wherein the joint extending from one end to another end of the outer peripheral surface in the axial direction and comprising a bending portion or a curving portion.

9. The sheet transport device according to claim 1, wherein each of the components comprises an identical shape.

10. The sheet transport device according to claim 1, wherein the components are integrally attached to form the assembled roller.

11. The image forming apparatus according to claim 8, wherein each of the components comprises an identical shape.

12. The image forming apparatus according to claim 8, wherein the components are integrally attached to form the assembled roller.

* * * * *